US011980244B1

(12) United States Patent
Phung

(10) Patent No.: US 11,980,244 B1
(45) Date of Patent: May 14, 2024

(54) METAL-LESS WAIST BELT WITH INTEGRAL LOCKING AND ALIGNMENT MECHANISM

(71) Applicant: Xuong Chieu Phung, Alhambra, CA (US)

(72) Inventor: Xuong Chieu Phung, Alhambra, CA (US)

( * ) Notice: Subject to any disclaimer, the term of this patent is extended or adjusted under 35 U.S.C. 154(b) by 0 days.

(21) Appl. No.: 18/382,489

(22) Filed: Oct. 21, 2023

(51) Int. Cl.
*A41F 9/00* (2006.01)

(52) U.S. Cl.
CPC ..... *A41F 9/002* (2013.01)

(58) Field of Classification Search
CPC ..... A41F 9/002; A43C 5/00
See application file for complete search history.

(56) References Cited

U.S. PATENT DOCUMENTS 1,479,150 A * 1/1924 Mellus ..... A41F 11/16 2/314
2,194,734 A * 3/1940 Brenner ..... A41F 9/002 2/320
2,445,889 A * 7/1948 Rossi ..... A41F 9/002 2/338
2,632,894 A * 3/1953 Louis ..... A41F 9/002 2/325
2,954,621 A * 10/1960 Mosher, Jr. ..... G09F 3/005 40/633
3,112,496 A * 12/1963 Dritz ..... A44B 11/258 2/322
3,210,820 A * 10/1965 Humiston ..... F16B 21/06 D11/220
3,438,063 A * 4/1969 Loston ..... A41F 9/002 2/322
4,173,794 A * 11/1979 Nichols ..... A44B 11/22 2/322
4,179,755 A * 12/1979 Clark ..... A41F 9/002 2/322
4,501,049 A * 2/1985 Adamson ..... B65D 63/1063 24/17 AP
4,833,807 A * 5/1989 McLean ..... G09F 3/0352 24/17 AP
D344,624 S * 3/1994 Schnel ..... D2/629
5,852,829 A * 12/1998 Relaford ..... A41F 9/002 2/311

(Continued)

*Primary Examiner* — Richale L Quinn
(74) *Attorney, Agent, or Firm* — Raymond Y. Chan; David and Raymond Patent Firm

(57) ABSTRACT

A metal-less waist belt includes a belt member integrally made to have an elongated belt strap and a fastening arrangement. The elongated belt strap has a first end portion, a second end portion and a belt body portion integrally extended between the first end portion and the second end portion. The fastening arrangement has at least two locking holes spacedly and intervally formed at the first end portion of the belt strap and a locking and alignment mechanism which is integrally formed at the second end portion of the belt strap and configured to lock with the at least two locking holes such that the first end portion is locked and aligned with the second end portion to form a fastening loop with a predetermined circumferential length. The metal-less waist belt has no metal component and is configured to be able to wear without taking off during the security test and allow the wearer to take off and to wear and fasten with one hand operation.

16 Claims, 8 Drawing Sheets

(56) References Cited

U.S. PATENT DOCUMENTS

| | | | | |
|---|---|---|---|---|
| 6,012,203 | A * | 1/2000 | Baron Pearson | A43B 23/24 24/114.9 |
| 7,178,364 | B2 * | 2/2007 | Shapiro | A44C 5/102 63/3 |
| 8,122,519 | B2 * | 2/2012 | Schmelzer | A43B 23/24 63/3 |
| 9,491,991 | B1 * | 11/2016 | Rong | A44C 5/2071 |
| 9,730,509 | B2 * | 8/2017 | Lee | A45F 5/00 |
| D843,997 | S * | 3/2019 | Yu | D14/344 |
| 2005/0251897 | A1 * | 11/2005 | LeBlanc | G10G 5/005 2/326 |
| 2011/0072560 | A1 * | 3/2011 | Valdez | A41F 9/002 24/3.1 |
| 2013/0117987 | A1 * | 5/2013 | Rienecker | A41F 9/002 2/311 |
| 2013/0227988 | A1 * | 9/2013 | Padgett | A61B 90/90 63/3.2 |
| 2017/0150787 | A1 * | 6/2017 | Custer | A44B 11/04 |
| 2017/0188665 | A1 * | 7/2017 | Greenham | A44B 11/22 |
| 2018/0035763 | A1 * | 2/2018 | Kumuchian | A44B 11/22 |
| 2019/0191824 | A1 * | 6/2019 | Cuthbert | A44B 11/22 |
| 2023/0141821 | A1 * | 5/2023 | Toso | A41D 13/0531 2/321 |

* cited by examiner

METAL-LESS WAIST BELT WITH INTEGRAL LOCKING AND ALIGNMENT MECHANISM

CROSS REFERENCE OF RELATED APPLICATION

Notice of Copyright

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to waist belt, and more particularly to a metal-less waist belt which is an integral belt configured to be worn by the wearer during security test with metal detector and/or X-ray scanner and adapted to be under-worn by the wearer.

Description of Related Arts

Waist belts that do hold up clothing such as pants and skirts work by friction or buckles and often take advantages of the narrow circumference and the compressibility of the torso above the hips. Belts often are used as fashion accessories, with many colors, styles, and finishes. There are various kinds of waist belt such as bullet belt, studded belt, buckle belt, woven belt, fabric belt, statement belt, dress belt, tactical belt, and etc.

A conventional waist belt comprises an elongated belt strap and a buckle affixed to one end of the belt strap. The belt strap is generally made of leather, synthetic leather and the like, and the buckle, such as frame buckle, box frame buckle, ring buckle, plate buckle, snap buckle, or the like, is made of metal and assembled to one end of the belt strap by stitching, screwing, clamping, pressing stud, or other fastening means.

The industry of producing leather or synthetic leather is the third-largest contaminated industry after papermaking and brewery industry, wherein tanning sewage is not only measured greatly and the organic waste water is a kind of complicated component with high density that contains hazardous and noxious substances such as lime, dyestuff, protein, salt, grease, ammonia nitrogen, sulfide, chromic salts, hairs, skin slag, slit particles, and other suspended substance. For example, a tanned pigskin leather process needs one ton of water and includes at least four procedures having pollution problems, including the hair removal procedure that the removing hair or feathers from raw pig skin with lime that causes alkaline pollution, the grease removal procedure that the pigskin after depilation is placed in a rotary drum with grease-removing agent added and tons of sewage will be produced, the limbering procedure where chrome tanning acid and softening additive is added after degreasing the pigskin but such additive is a poison that just 0.01 g is enough to carcinogenic, and the dyeing procedure thereafter also cause great pollution.

Also, no matter the synthetic leather is produced by the wet method and the dry method, pollutants such as DMF (dimethylformamide), TOL (toluene), butanone, MEK (methylethylketone) organic exhaust gases, waste water and waste residue are produced during the coating, impregnation, and oven drying processes, that causes comparatively serious exhaust emission problems. For examples, DMR can invade human body through respiratory tract, skin and digestive tube causing toxic reaction. Toluene has big pungency to skin mucosa and can invade human body through respiratory tract and skin, influencing hematopoietic function and neural system. Butanone has to stimulate and anesthetic action, and long-term contact with butanone of skin can suppress sensation and produce dermatitis, hand and numbness of the fingers.

On the other hand, a normal individual has no problem to take off the waist belt for security test in the airport or at the entrance of a federal facility. However, for handicaps, disable people or seniors, especially to who is using walking cane, walker or wheelchair, it is inconvenience and not safe for him or her to take off and rewear the waist belt for passing the security test without assistance. For obese people, the waist belt is a tool for wearing his or her pants that once the waist belt is taken off, his or her pants will fall off and it is embarrassing to the obese person to keep using hands to hold the pants throughout the security test.

In addition, most of the waist belts in the market are designed for external use that is not suitable for underwearing as an underwear belt which can be worn by the user for internal use such as wearing underwear for obese people, carrying internal pouch or pocket under external clothing, and etc.

SUMMARY OF THE PRESENT INVENTION

The invention is advantageous in that it provides a metal-less waist belt configured to be able to wear without taking off during the security test, wherein no metal made component is configured while an integral locking and alignment mechanism is configured for fastening the waist belt in desire position.

Another advantage of the invention is to provide a molded waist belt which comprises only one elongated belt member with built-in locking alignment mechanism that not only is simple in configuration and minimizes manufacturing cost, but also allows the wearer to take off and to wear and fasten with one hand operation.

Another advantage of the invention is to provide a configuration of a waist belt that allows the waist belt to be made of stretching resistance and anti-deformation artificial material, such as TPU (thermoplastic polyurethane), EVA (ethyle acetate), PVC (polyvinyl chloride) and the like, by molding to have an elongated belt strap and a fastening arrangement having at least two locking holes equally spacedly and intervally formed along a first end portion of the belt strap and a locking and alignment mechanism integrally formed at a second end portion of the belt strap and configured to lock with the at least two locking holes such that the first end portion is locked and aligned with the second end portion to form a fastening loop with desired circumferential length.

Another advantage of the invention is to provide a locking and alignment mechanism integrally formed in a belt strap to form a waist belt, which not only allows the user to fasten with an end portion of the belt strap with one hand, but also aligns a locking portion of the belt strap with a fastening portion of the belt strap parallelly and overlappedly to form a fastening loop and avoids any unintentional displacement or detachment therebetween without any extra component.

Another advantage of the invention is to provide an integral waist belt which comprises only one elongated belt member that minimizes its cost and simplifies its manufacturing process to one single step.

According to the present invention, the foregoing and other objects and advantages are attained by a waist belt comprising a belt member integrally made to have:

an elongated belt strap having a first end portion, a second end portion and a belt body portion integrally extended between the first end portion and the second end portion, and a fastening arrangement having at least two locking holes spacedly and intervally formed at the first end portion of the belt strap and a locking and alignment mechanism which is integrally formed at the second end portion of the belt strap and configured to lock with the at least two locking holes such that the first end portion is locked and aligned with the second end portion to form a fastening loop with a predetermined circumferential length.

In one embodiment, the first end portion and the belt body portion has a predetermined thickness, and the second end portion is configured to have a thickness thicker than the predetermined thickness of the first end portion and the belt body portion to form a belt head, wherein the locking and alignment mechanism comprises at least two locking pins integrally protruded from an inner side of the belt head and arranged spacedly and longitudinally, wherein each of the locking pins has a locking shaft perpendicularly and integrally extended from the inner side of the belt head and an enlarged engaging head formed at a distal end of the locking shaft. Further, a locking distance defined between the at least two locking pins is equal to a distance between the at least two locking holes such that the two engaging heads are capable of penetrating through the at least two locking holes respectively until the two locking shafts are retained in the at least two locking holes respectively so as to lock the belt head of the second end portion with the first end portion of the belt member to form the fastening loop.

In one embodiment, the second end portion and the belt body portion has a predetermined width, and the first end portion is configured to have a width wider than the predetermined width of the second end portion and the belt body portion to form a belt head, wherein the at least two locking holes are parallelly and transversally formed in the belt head and each of the at least two locking holes has a length equal to or slightly longer than the predetermined width of the belt body portion and the second end portion, wherein the locking and alignment mechanism comprises a plurality of parallel locking teeth formed on the inner side of the first end portion spacedly and transversally. To fasten the belt head with the second end portion, the second end portion is first penetrating through one of the two locking holes from an inner side of the belt head to an outer side of the belt head and then penetrates through the other one of the two locking holes from the outer side of the belt head to the inner side of the belt head to form the fastening loop while one of the locking teeth is able to be engaged with the belt head.

In accordance with another aspect of the invention, the present invention provides a metal-less waist belt with integral locking and alignment mechanism, wherein the entire waist belt is made from a step of molding an artificial material selected from the group consisting of thermoplastic polyurethane (TPU), ethyle acetate (EVA), polyvinyl chloride (PVC) and the like by injection mould or compression mould.

Still further objects and advantages will become apparent from a consideration of the ensuing description and drawings.

These and other objectives, features, and advantages of the present invention will become apparent from the following detailed description, the accompanying drawings, and the appended claims.

Figure 1:
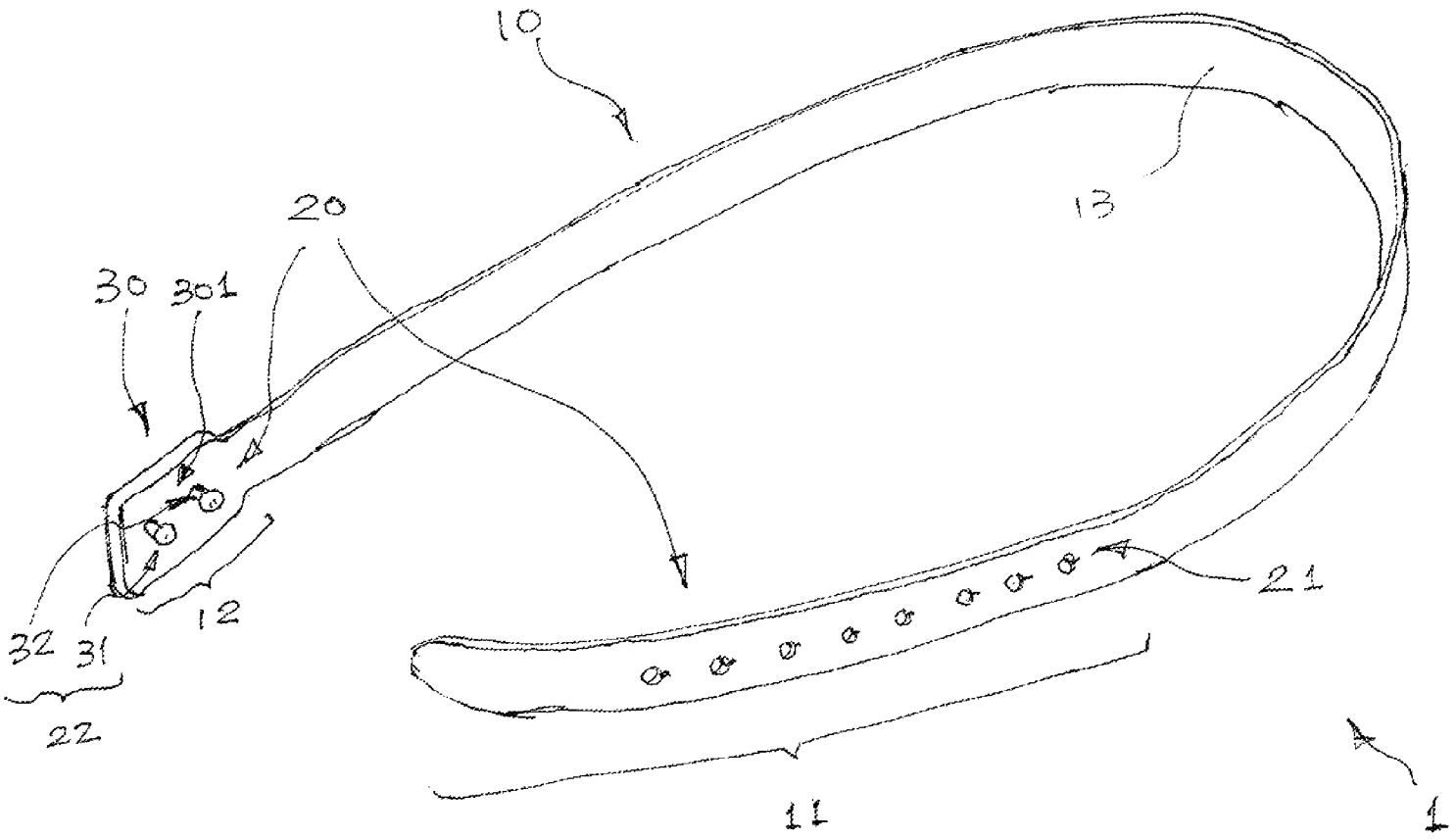
FIG. 1 is a perspective view of a metal-less waist belt with integral locking and alignment mechanism according to a preferred embodiment of the present invention.

The drawings, described above, are provided for purposes of illustration, and not of limitation, of the aspects and features of various examples of embodiments of the invention described herein. The drawings are not intended to limit the scope of the claimed invention in any aspect. For simplicity and clarity of illustration, elements shown in the drawings have not necessarily been drawn to scale and the dimensions of some of the elements may be exaggerated relative to other elements for clarity.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Further, this description is not to be considered as limiting the scope of the embodiments described herein in any way, but rather as merely describing implementation of the one or more embodiments described herein.

Please referring to FIG. 1 to FIG. 3A, according to a preferred embodiment of the present invention, a waist belt is provided, which is a molded integral and elongated strap body comprising a belt member 1 integrally made by a non-metal artificial material to have an elongated belt strap 10 and a fastening arrangement 20.

The belt strap 10 has a first end portion 11, a second end portion 12 and a belt body portion 13 integrally extended between the first end portion 11 and the second end portion 12.

The fastening arrangement 20 has a plurality of locking holes 21 spacedly and intervally formed at the first end portion 11 of the belt strap 10 and a locking and alignment mechanism 22 is integrally formed at the second end portion 12 of the belt strap 10 and configured to selectively lock with two of the plurality of locking holes 21, such that the first end portion 11 is locked and aligned with the second end portion 12 to form a fastening loop 100 with a predetermined circumferential length matching with a waist length of a wearer of the belt member 1 of the waist belt of the present invention.

According to the preferred embodiment, the first end portion 11 and the belt body portion 13 has a predetermined thickness T1 and the second end portion 12 is configured to have a thickness T2 thicker than the predetermined thickness T1 of the first end portion 11 and the belt body portion 13 to form a rigid reinforced belt head 30 adapted for bearing force and strength and for ease of operation. The predetermined thickness T1 and the material used to mold the belt member 1 are adapted for allowing the second portion 12 and the belt body portion 13 to be flexibly bent around a waist portion of the wearer.

The locking and alignment mechanism 22 comprises at least two locking pins 31, 32 integrally protruded from an inner side 301 of the belt head 30 and arranged spacedly and longitudinally with a locking distance D defined therebetween, wherein Each two adjacent locking holes 21 has the same distance D therebetween. Each of the locking pins 31, 32 has a circular locking shaft 311, 321 perpendicularly and integrally extended from the inner side 301 of the belt head 30 and an enlarged engaging head 312, 322 such that the two engaging heads 312, 322 of the at least two locking pins 31, 32 are capable of penetrating through two adjacent locking holes 21 of the plurality of locking holes 21 respectively until the two locking shafts 311, 312 are retained in the two locking holes 21 respectively so as to lock the belt head 30 of the second end portion 12 with the first end portion 11 of the belt member 10 to form the fastening loop 100.

According to the preferred embodiment, each of the locking pins 31, 32 has a mushroom shape, wherein each of the locking shafts 311, 321 has a diameter and height respectively equal to or slightly smaller than a diameter and a depth of each of the plurality of locking holes 21 and each of the engaging heads 312, 322 has a ball shape or a semi-circular shape having a size slightly larger than the diameter of the locking shaft 311, 321 thereof and the diameter of each of the plurality of locking holes 21.

Figure 2:
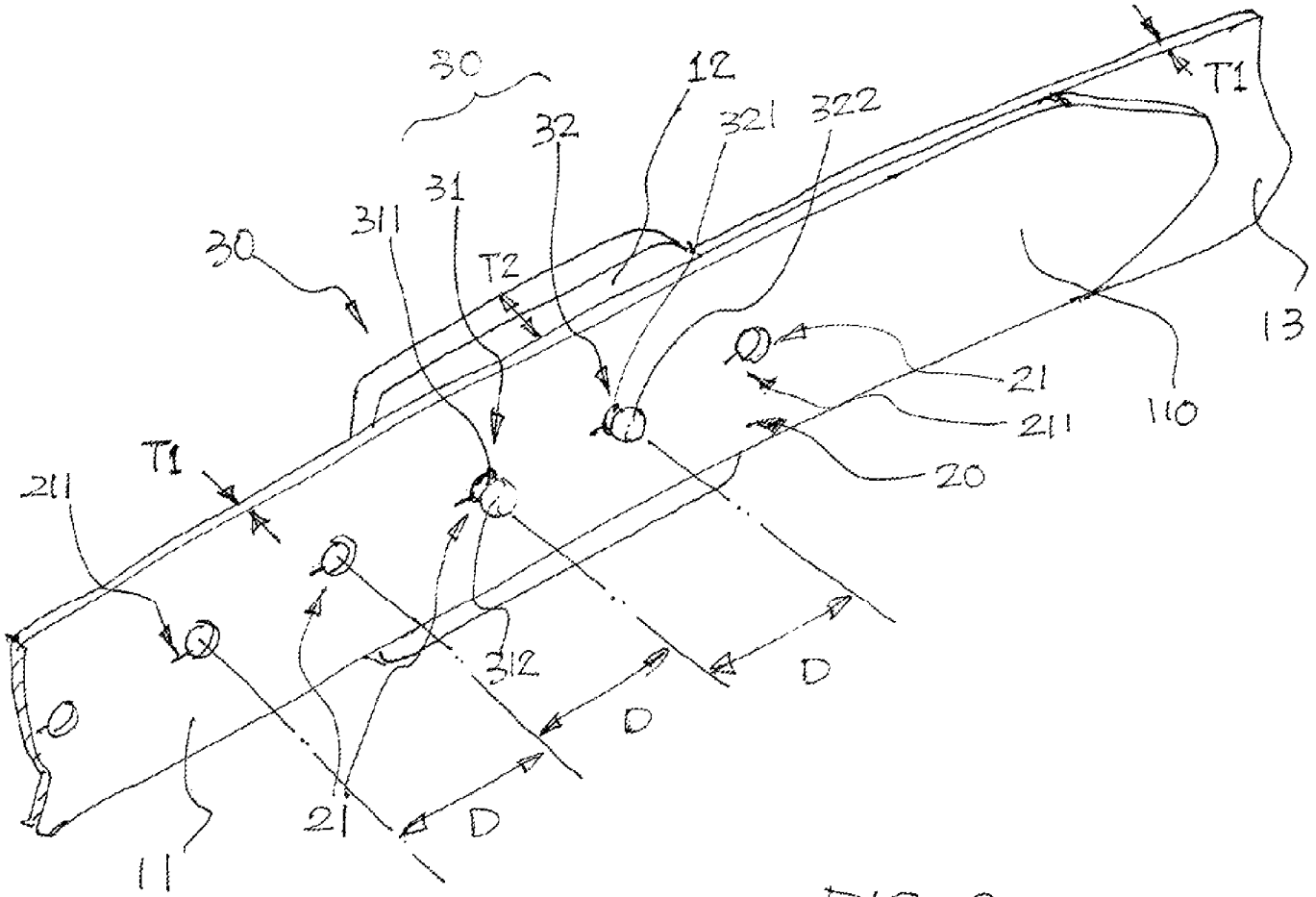
FIG. 2 is a partial perspective view illustrating a fastening arrangement of the metal-less waist belt with integral locking and alignment mechanism according to the above preferred embodiment of the present invention.

Referring to FIG. 2, each of the locking holes 21 is a through hole and may further have at least one short edge-cut 211 extended from an edge of the through hole facilitating the respective enlarged engaging head 321, 322 to pass through the locking hole 21, so that it is easily and smooth either to insert the engaging heads 312, 322 through the locking holes 21 or to pull the interlocked engaging heads 312, 322 out through the locking holes 21.

In view of above, no metal made component is configured while belt head 3 and the integral locking and alignment mechanism 22 is integrally formed. The whole piece of belt member 1 is preferred to be made of artificial material, such as thermoplastic polyurethane (TPU), ethyle acetate (EVA), polyvinyl chloride (PVC) and the like, by means of injection mould or compression mould through one single molding step. According to the preferred embodiment, the entire belt member 1 can be made in transparent color or any desire color with flat and smooth surface or any other desire surface pattern formed simply through the molding process.

Figure 3A:
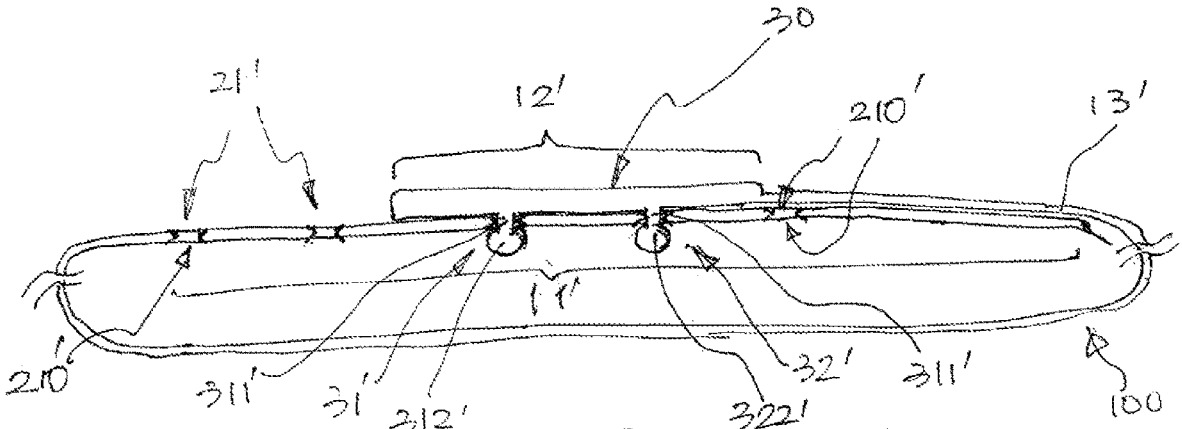
FIG. 3A is a sectional view illustrating a first alternative mode of the fastening arrangement of the metal-less waist belt with integral locking and alignment mechanism according to the above preferred embodiment of the present invention.

The rigidity and flexibility of the belt strap 10 can be controlled by the formula of the molding material and the thickness thereof. The thicker the second end portion 12 to form the belt head 30, the more rigid is the belt head 30 to ensure the engagement of locking pins 31, 32 with the locking holes 21 in the first end portion 11. The wearer may control the circumferential length of the fastening loop 100 (as shown in FIG. 3A) of the waist belt by engaging the pair of locking pins 31, 32 with designated pair of adjacent locking holes 21 to fit his or her waist size.

It is appreciated that the dual interlocking configuration of the fastening arrangement 20 of the present invention is simple, secure and effective and is easy to be operated by the wearer with one hand, wherein the at least two locking pins 31, 32 of the locking and alignment mechanism 30, protruded on the inner side 301 of the belt head 30, are aligned longitudinally with respect to the linear alignment of the locking holes 21, the first end portion 11 can be aligned and interlocked with the second end portion 12 securely that not only avoids unintentional displacement with each other, but also prevents unintentional detachment of the belt head 30 from the first end portion 11 of the belt strap 10. In other word, as shown in FIG. 2, the remaining part 110 of the first end portion 11 is forced and restrict to be extended along the belt body portion 13 parallelly and overlapped by the dual interlocking of the at least two engaging pins 31, 32 and to prevent any pivotal up and down movement of the remaining part 110 with respect to the second end portion 12, i.e. the belt head 30.

Figure 8:
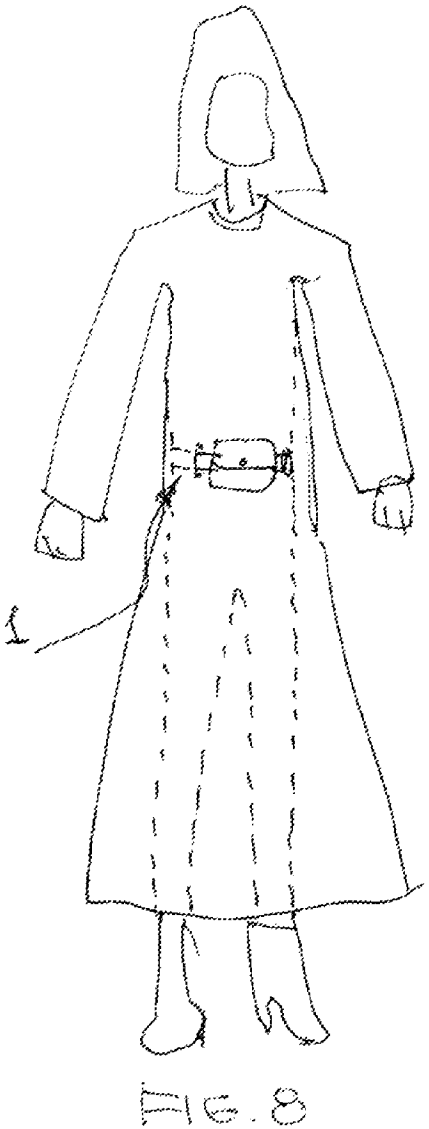
FIG. 8 is a schematic view illustrating a first application of the metal-less waist belt with integral locking and alignment mechanism according to the above preferred embodiment of the present invention.

The waist belt of the present invention is worn on the wearer's waist portion in such a manner that the remaining first end is extended behind the belt body portion 13, so that the entire belt strap 10 form an endless round strap around the waist portion of the wearer that significantly provides a more secure binding ability and prevents any accidental detachment of the belt member 1. It works perfectly to pants or skirt even without waist loops. When the entire belt member 1 is made transparent, the waist belt of the present invention is an invisible belt that fits to most fashion without undermining the original fashion design. For example, when a lady wearing a fashion dress and like to hang her pouch around the waist portion, she may use the transparent belt member 1 to carry the pouch with her without anxious of whether a belt is match with her dress, as shown in FIG. 8.

Figure 9:
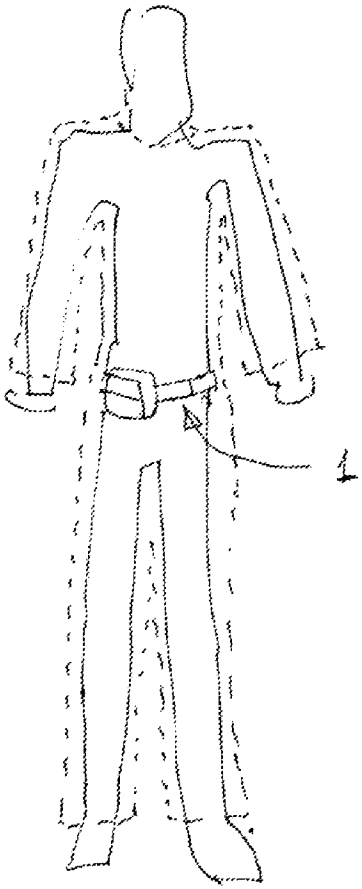
FIG. 9 is a schematic view illustrating a second application of the metal-less waist belt with integral locking and alignment mechanism according to the above preferred embodiment of the present invention.

In addition, thanks to the configuration of the waist belt of the present invention as described above, the molded integral waist belt is perfect to be used internally, that is utilizing as an underwearing belt, so that the user may use the waist belt, preferably being made of softer material and having a thinner thickness, with the underwear below the outside clothing. It is especially useful for individuals like travelers to carry personal and important items (such as cash, passport or ID) with an internal pouch or pocket that can be carried by wearing the waist belt of the present invention. As shown in FIG. 9, a clothing may also provide two loop openings, so that the user may wear the belt member 1 inside the clothing while a portion of the belt strap 10 is extended outside the clothing through the two loop openings for carrying a pouch or pocket externally.

Referring to FIG. 3A, a first alternative mode of the fastening arrangement of the waist belt of the present invention is illustrated, wherein each of the locking holes 21' is a countersunk hole having has a "\ /" cross sectional shape defining at least a concave end opening 210' at an outer end thereof and having a size slightly larger than that of the locking shaft 311', 321' and smaller than that of the engaging head 312', 322' of the locking pin 31', 32'. Thereby, the concave end opening 210' facilitates the inserting and detaching of the engaging head 312, 322 through the respective locking holes 21'. Alternatively, when the locking hole 21' has a ") (" or "><" cross sectional shape, concave end openings 210' are formed at both ends of the locking hole 21' and a root portion of the engaging head 312', 322' can be rested in the concave end opening 210' of the respective locking hole 21'.

Figure 3B:
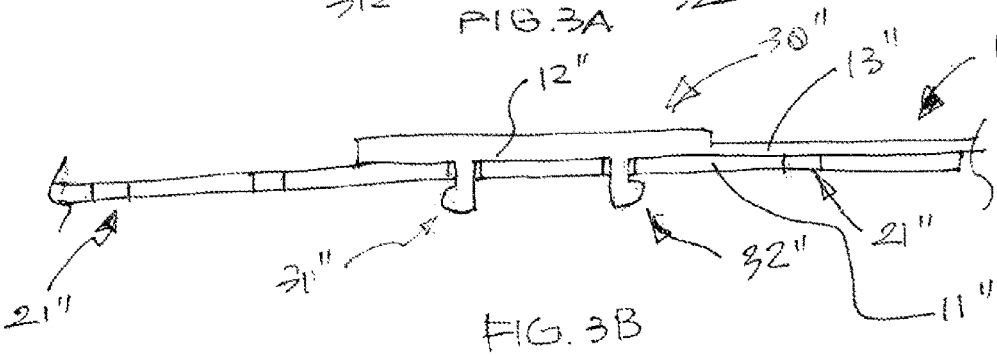
FIG. 3B is a sectional view illustrating a second alternative mode of the fastening arrangement of the metal-less waist belt with integral locking and alignment mechanism according to the above preferred embodiment of the present invention.

Referring to FIG. 3B, a second alternative mode of the fastening arrangement of the waist belt of the present invention is illustrated, each of the engaging heads 312", 322" of the locking pins 31", 32" has a semi-circular shape and is enlarged towards opposing directions to form a "d b" arrangement that facilitates the inserting and detaching of the semi-circular engaging heads 312", 322" through the locking holes 21". The wearer may use one hand to engage the second locking pin 32" with the respective locking hole 21" first to fasten the belt head 30" with the first end portion 11" of the belt strap 10" and then engage the first locking pin 31" with another adjacent locking hole 21" to interlock and align the first end portion 11" with the belt head 30" (the second end portion 12") and the belt body portion 13".

Figure 3C:
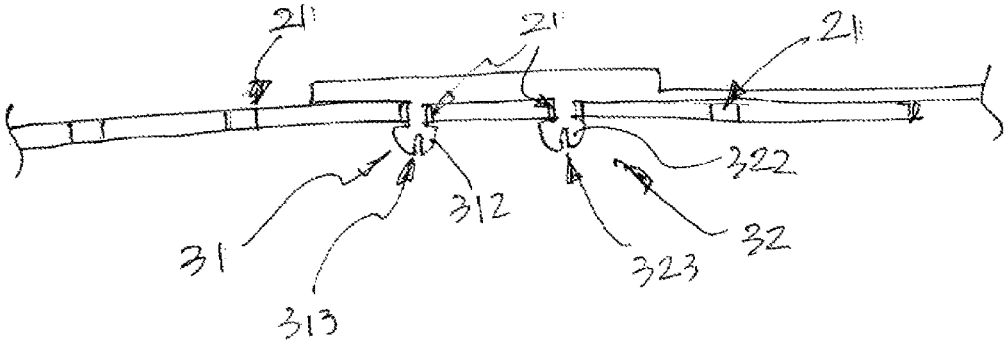
FIG. 3C is a sectional view illustrating a third alternative mode of the fastening arrangement of the metal-less waist belt with integral locking and alignment mechanism according to the above preferred embodiment of the present invention.

Referring to FIG. 3C, a third alternative mode of the fastening arrangement of the waist belt of the present invention is illustrated, wherein each of the engaging heads 312, 322 has a semi-circular shape and an end slot 313, 323 formed at a tip portion thereof, wherein the end slot 313, 323 allows the respective engaging head 312, 322 to deform and reduce its size while passing through the respective locking hole 21 for facilitating the insertion and detachment of the locking pins 31, 32 through the locking holes 21.

Figure 4:
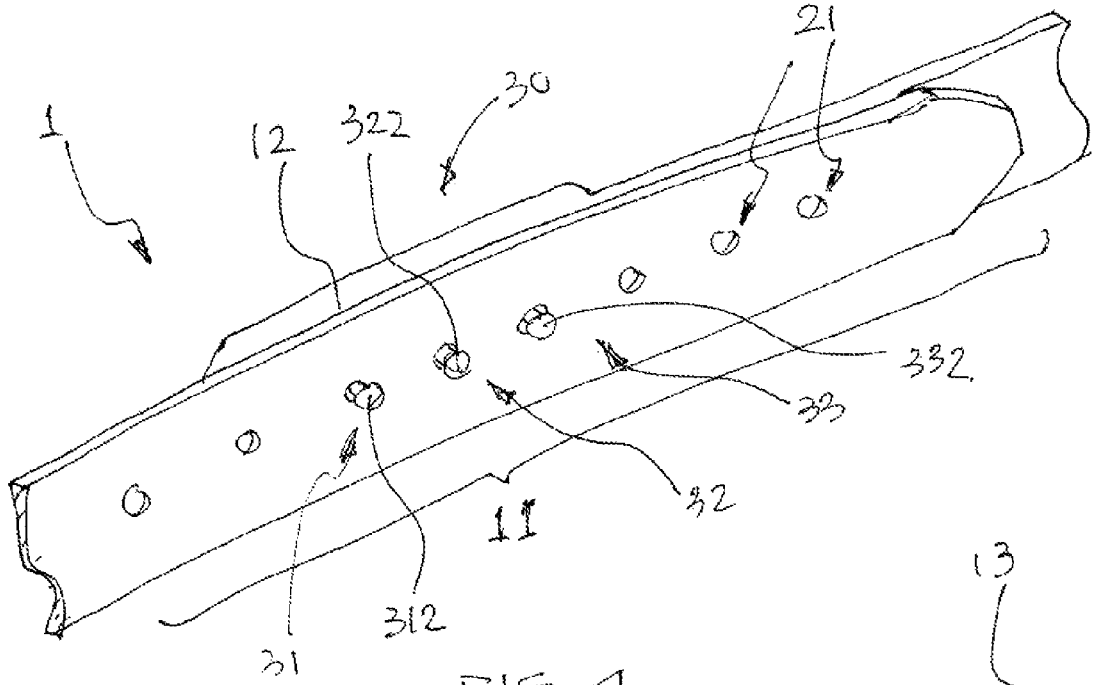
FIG. 4 is a partial perspective view of a fourth alternative mode of the fastening arrangement of the metal-less waist belt with integral locking and alignment mechanism according to the above preferred embodiment of the present invention.

Referring to FIG. 4, a fourth alternative mode of the fastening arrangement of the waist belt of the present invention is illustrated, wherein the locking and alignment mechanism 22 comprises three engaging pins 31, 32, 33 arranged in linear pattern for engaging with three adjacent locking holes 21 at the same time to enhance the interlocking and alignment of the belt head 30 (the second end portion 12) and the first end portion 11, that is specifically efficient to obese people having relatively bigger waist size. It is worth mentioning that each of the engaging heads 312, 322, 332 can also embodied as the alternative modes as shown in FIG. 3A to FIG. 3C.

Figure 5:
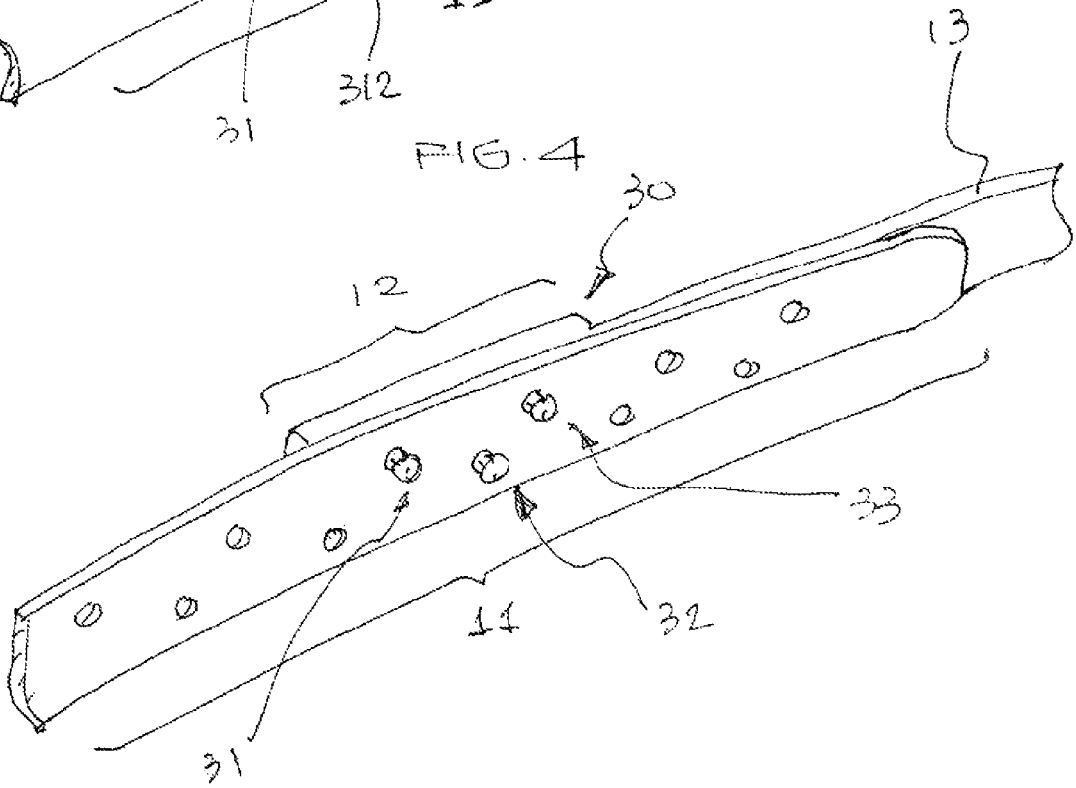
FIG. 5 is a partial perspective view of a fifth alternative mode of the fastening arrangement of the metal-less waist belt with integral locking and alignment mechanism according to the above preferred embodiment of the present invention.

Referring to FIG. 5, a fifth alternative mode of the fastening arrangement of the waist belt of the present invention is illustrated, wherein the locking and alignment mechanism 22 comprises three engaging pins 31, 32, 33 arranged in a "V" pattern while the plurality of locking holes 21 formed in the first end portion 11 is arranged in zig-zag manner that effectively enhances the interlocking ability and strengthens the fastening of the belt head 30 and the first end portion 11 of the belt strap 10.

Figure 6:
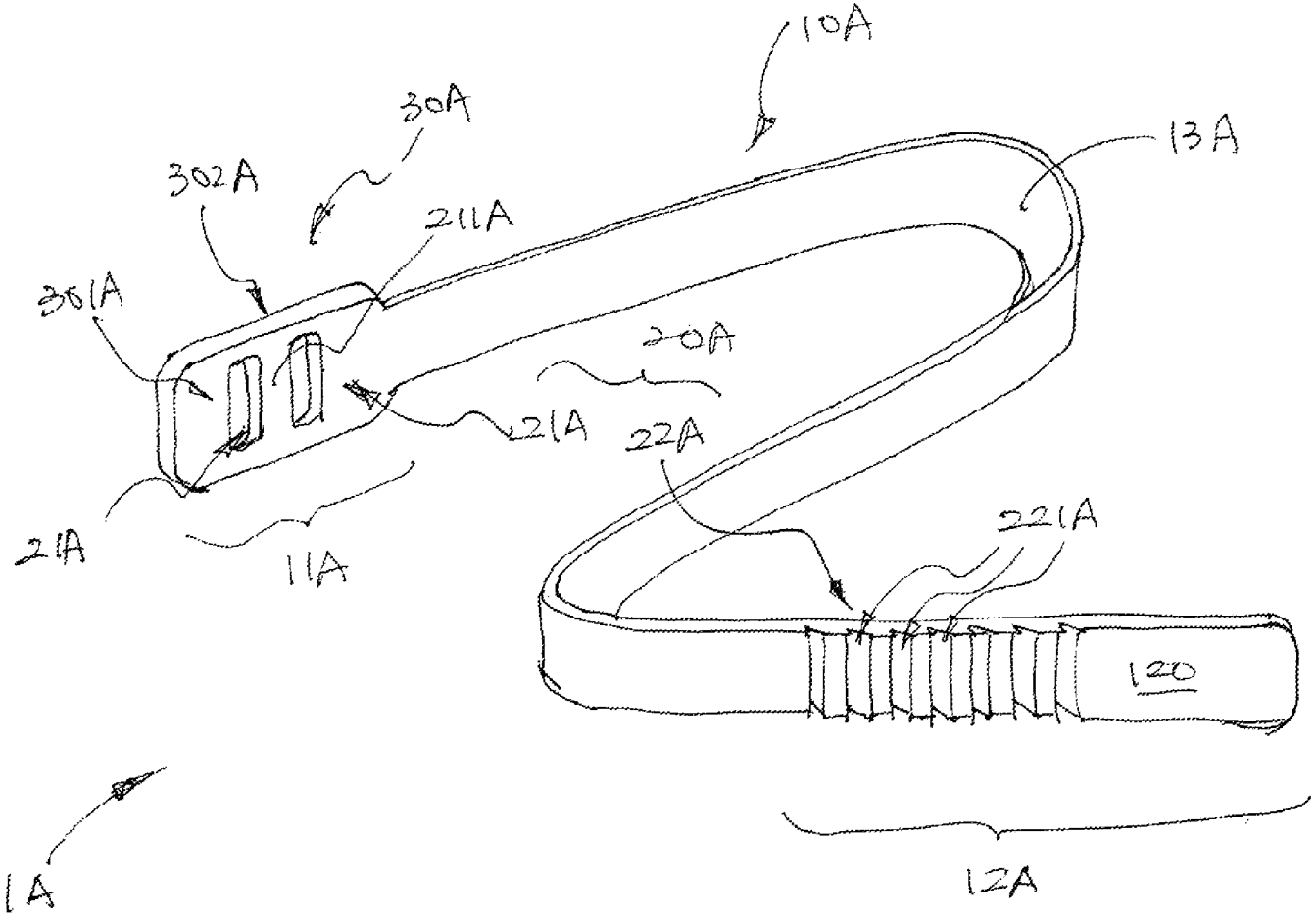
FIG. 6 is a perspective view of the metal-less waist belt with integral locking and alignment mechanism according to an alternative mode of the preferred embodiment of the present invention.
Figure 7A:
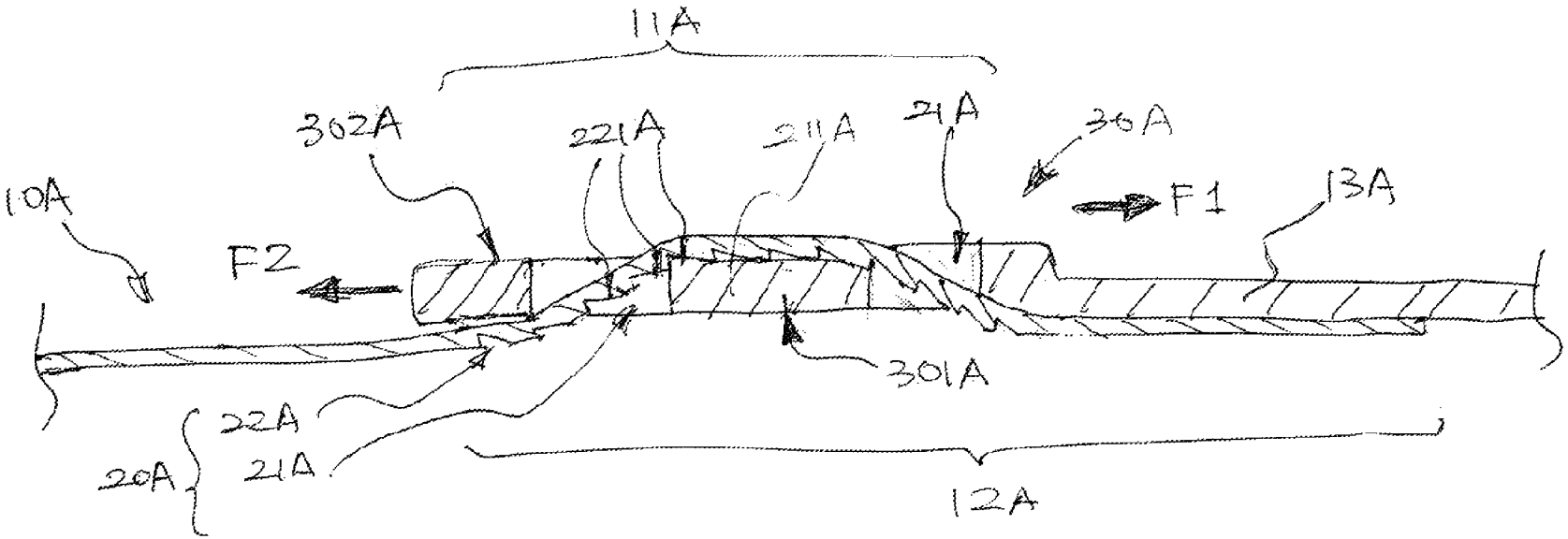
FIG. 7A is a sectional view illustrating the fastening arrangement of the metal-less waist belt with integral locking and alignment mechanism according to the above alternative mode of the preferred embodiment of the present invention.

Referring to FIG. 6 to FIG. 7A, an alternative mode of the integral waist belt according to the above preferred embodiment is illustrated, wherein the waist belt is a molded integral and elongated strap body comprising a belt member 1A integrally made by a non-metal artificial material to have an elongated belt strap 10A and a fastening arrangement 20A.

The belt strap 10A has a first end portion 11A, a second end portion 12A and a belt body portion 13A integrally extended between the first end portion 11A and the second end portion 12A.

The fastening arrangement 20A has a pair of locking holes 21A spacedly and intervally formed at the first end portion 11A of the belt strap 10A and a locking and alignment mechanism 22A integrally formed at the second end portion 12A of the belt strap 10A and configured to selectively lock with the pair of locking holes 21A, such that the first end portion 11A is locked and aligned with the second end portion 12A to form a fastening loop with a predetermined circumferential length matching with a waist length of a wearer of the belt member 1 of the waist belt of the present invention.

The second end portion 12A and the belt body portion 13A has a predetermined width, and the first end portion 11A is configured to have a width wider than the predetermined width of the second end portion 12A and the belt body portion 13A to form a belt head 30A, wherein the pair of locking holes are parallelly and transversally formed in the belt head and each of the pair of locking holes 21A is an elongated slot having a length equal to or slightly longer than the predetermined width of the belt body portion 13A and the second end portion 12A, wherein the locking and alignment mechanism 22A comprises a plurality of parallel locking teeth 221A formed on an inner side 120A of the first end portion 12A spacedly and transversally. To fasten the belt head 30A with the second end portion 12A, the second end portion 12A is first penetrating through an outer locking hole 21A of the pair locking holes 21A from an inner side 301A of the belt head 30A to an outer side 302A of the belt head 30A and then penetrates through an inner locking hole 21A of the pair of locking holes 21A from the outer side 302A of the belt head 30A to the inner side 301A of the belt head 30A to form the fastening loop while one of the locking teeth 221A is able to be engaged with an edge side of a locking bar 211A between the pair of locking holes 21A of the first end portion 11A, i.e. the belt head 30A, when opposing forces F1, F2 are applied to belt head 30A and the second end portion 12A respectively in opposite directions, such that the first end portion 11A is locked and aligned with the second end portion 12A to form the fastening loop to be worn on the waist portion of the wearer.

Figure 7B:
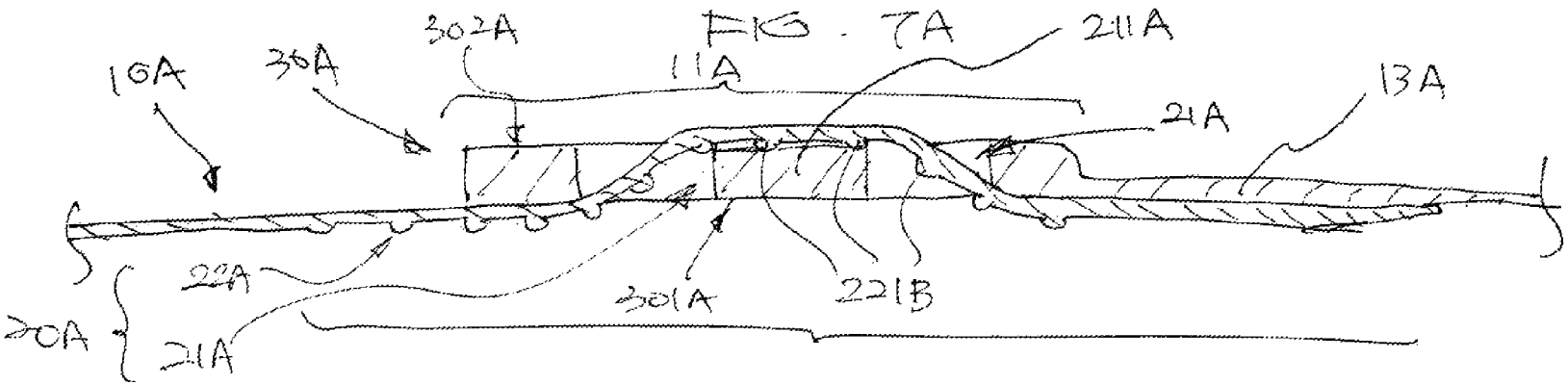
FIG. 7B is a sectional view illustrating an alternative mode of the fastening arrangement of the metal-less waist belt with integral locking and alignment mechanism according to the above alternative mode of the preferred embodiment of the present invention.

Referring to FIG. 7A, the plurality of locking teeth 221A is formed by a plurality of V-shaped grooves indented transversally and parallelly along the second end portion 12A. Referring to FIG. 7B, another alternative mode of the integral waist belt as shown in FIG. 6 and FIG. 7A according to the above preferred embodiment is illustrated, wherein the plurality of locking teeth 221B is formed by a plurality of ridges protruded transversally and parallelly along the second end portion 12A.

According to the above embodiment and alternative modes thereof as illustrated in FIG. 1 to FIG. 7B, the metal-less waist belt with integral locking and alignment mechanism of the present invention can be made from a step of molding an artificial material selected from the group consisting of thermoplastic polyurethane (TPU), ethyle acetate (EVA), polyvinyl chloride (PVC) and the like by injection mould or compression mould. Since no metal made component is configured, the metal-less waist belt is able to wear by the wearer without taking off during the security test. Therefore, the waist belt of the present invention may also utilize as an underwearing belt for the wearer.

Figure 10:
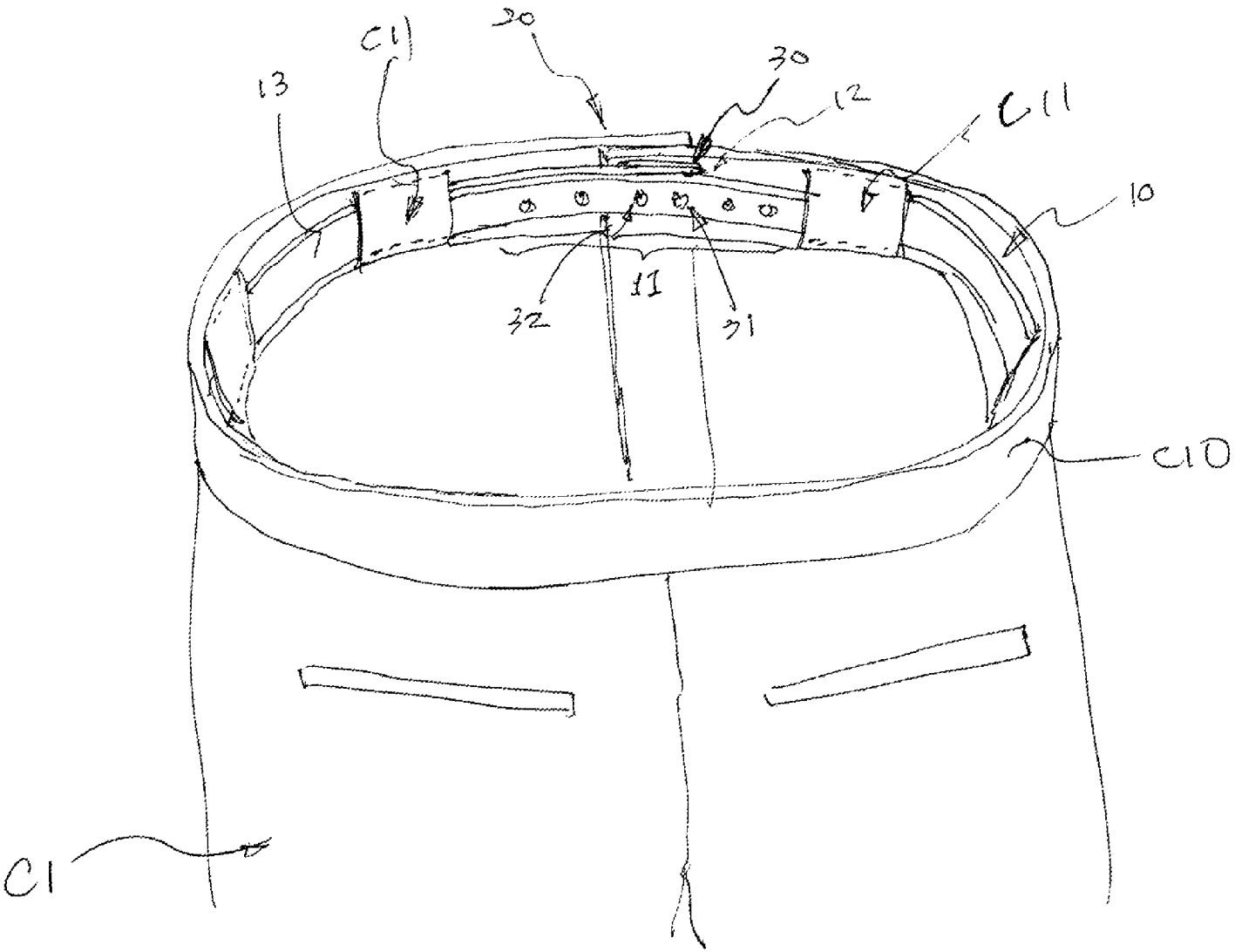
FIG. 10 is a schematic view illustrating a third application of the metal-less waist belt with integral locking and alignment mechanism according to the above preferred embodiment of the present invention.

The innovative configuration of the metal-less waist belt with locking and alignment mechanism of the present invention allows the fashion designer to design and configure a clothing article Cl, such as a pant or a skirt, to have a flat and neat waistband C10 while providing fitting capability of a waist belt to the wearer without exposing the waist belt outside. Referring to FIG. 10, an inner side of the waistband C10 can be designed to provide a belt channel or a plurality of belt loop members C11 to define the belt channel to allow the metal-less waist belt 1 of the present invention, made of durable and flexible material and having a thickness as thin as 1 mm to 2 mm, to be worn along the inner side of the waistband C10, such that the pants Cl has a fashion and neat appearance while maintaining the fitting capability of using the waist belt by the wearer selectively.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A metal-less waist belt, comprising a belt member integrally made to have:

an elongated belt strap having a first end portion, a second end portion and a belt body portion integrally extended between said first end portion and said second end portion, wherein said first end portion and said belt body portion has a predetermined thickness and said second end portion is configured to have a thickness thicker than said predetermined thickness of said first end portion and said belt body portion to form a belt head, and a fastening arrangement having at least two locking holes spacedly and intervally formed at said first end portion of said belt strap and a locking and alignment mechanism which is integrally formed at said second end portion of said belt strap and configured to lock with said at least two locking holes such that said first end portion is locked and aligned with said second end portion to form a fastening loop with a predetermined circumferential length, wherein said locking and alignment mechanism comprises at least two locking pins integrally protruded from an inner side of said belt head and arranged spacedly and longitudinally, wherein each of said at least two locking pins has a locking shaft integrally extended from said inner side of said belt head and an enlarged engaging head formed at a distal end of said locking shaft, wherein a locking distance defined between said at least two locking pins is equal to a distance between aid at least two locking holes such that said two engaging heads are capable of penetrating through said at least two locking holes respectively until said two locking shafts are retained in said at least two locking holes respectively so as to lock said belt head with said first end portion of said belt member to form said fastening loop.

2. The metal-less waist belt, as recited in claim 1, wherein said belt member is made of an artificial material selected from a group consisting of thermoplastic polyurethane (TPU), ethyle acetate (EVA), polyvinyl chloride (PVC), and a combination thereof by molding.

3. The metal-less waist belt, as recited in claim 1, wherein each of said locking pines has a mushroom shape, wherein each of said locking shafts has a diameter and height respectively equal to or slightly smaller than a diameter and a depth of each of each of said at least two locking holes and each of said engaging heads has an enlarged size slightly larger than said diameter of said locking shaft and said diameter of each of said at least two locking holes.

4. The metal-less waist belt, as recited in claim 3, wherein each of said locking holes is a through hole and has a least one edge-cut extended from an edge of said through hole facilitating said respective engaging head to pass through said locking hole.

5. The metal-less waist belt, as recited in claim 3, wherein each of said locking holes has at least a concave end opening being formed at one end thereof and having a size slightly larger than that of said locking shaft and smaller than that of said engaging head for facilitating an inserting and detaching of said at least two engaging head through said at least two locking holes respectively.

6. The metal-less waist belt, as recited in claim 3, wherein each of said engaging heads of said at least two locking pins has an end slot formed at a tip portion thereof so as to allow said respective engaging head to deform and reduce a size thereof while passing through said respective locking hole for facilitating an insertion and detachment of said at least two locking pins through said at least two locking holes.

7. The metal-less waist belt, as recited in claim 2, wherein each of said locking pines has a mushroom shape, wherein each of said locking shafts has a diameter and height respectively equal to or slightly smaller than a diameter and a depth of each of each of said at least two locking holes and each of said engaging heads has an enlarged size slightly larger than said diameter of said locking shaft and said diameter of each of said at least two locking holes.

8. The metal-less waist belt, as recited in claim 7, wherein each of said locking holes is a through hole and has a least one edge-cut extended from an edge of said through hole facilitating said respective engaging head to pass through said locking hole.

9. The metal-less waist belt, as recited in claim 7, wherein each of said locking holes has at least a concave end opening being formed at one end thereof and having a size slightly larger than that of said locking shaft and smaller than that of said engaging head for facilitating an inserting and detaching of said at least two engaging head through said at least two locking holes respectively.

10. The metal-less waist belt, as recited in claim 2, wherein each of said engaging heads of said at least two locking pins has an end slot formed at a tip portion thereof so as to allow said respective engaging head to deform and reduce a size thereof while passing through said respective locking hole for facilitating an insertion and detachment of said at least two locking pins through said at least two locking holes.

11. The metal-less waist belt, as recited in claim 2, wherein said locking and alignment mechanism further comprise a third engaging pin arranged with said at least two engaging pins in a "V" pattern and said at least two locking holes of said first end portion is arranged in zig-zag manner with respect to positions of said third engaging pin and said at least two engaging pins.

12. The metal-less waist belt, as recited in claim 1, wherein each of said engaging heads of said at least two locking pins has an end slot formed at a tip portion thereof so as to allow said respective engaging head to deform and reduce a size thereof while passing through said respective locking hole for facilitating an insertion and detachment of said at least two locking pins through said at least two locking holes.

13. The metal-less waist belt, as recited in claim 1, wherein said locking and alignment mechanism further comprise a third engaging pin arranged with said at least two engaging pins in a "V" pattern and said at least two locking holes of said first end portion is arranged in zig-zag manner with respect to positions of said third engaging pin and said at least two engaging pins.

14. A metal-less waist belt, comprising a belt member integrally made to have:

an elongated belt strap having a first end portion, a second end portion and a belt body portion integrally extended between said first end portion and said second end portion, wherein said second end portion and said belt body portion has a predetermined width, and said first end portion is configured to have a width wider than said predetermined width of said second end portion and said belt body portion to form a belt head, wherein said pair of locking holes is parallelly and transversally formed in said belt head and each of said pair of locking holes is an elongated slot having a length equal to or slightly longer than said predetermined width of said belt body portion and said second end portion, and a fastening arrangement having a pair of locking holes spacedly and intervally formed at said first end portion of said belt strap and a locking and alignment mechanism integrally formed at said second end portion of said belt strap and configured to selectively lock with said pair of locking holes, such that said first end portion is locked and aligned with said second end portion to form a fastening loop with a predetermined circumferential length, wherein said locking and alignment mechanism comprises a plurality of parallel locking teeth formed on an inner side of said first end portion spacedly and transversally, such that said second end portion is able to be fastened with said belt head by firstly penetrating through an outer locking hole of said pair locking holes from an inner side of said belt head to an outer side of said belt head and then penetrating through an inner locking hole of said pair of locking holes from said outer side of said belt head to said inner side of said belt head to form said fastening loop while one of said plurality of locking teeth is able to be engaged with an edge side of a locking bar between said pair of locking holes of said first end portion.

15. The metal-less waist belt, as recited in claim 14, wherein said plurality of locking teeth is formed by a plurality of V-shaped grooves indented transversally and parallelly along said second end portion.

16. The metal-less waist belt, as recited in claim 14, wherein said plurality of locking teeth is formed by a plurality of ridges protruded transversally and parallelly along said second end portion.

* * * * *